US009033150B2

(12) United States Patent
Andrich et al.

(10) Patent No.: US 9,033,150 B2
(45) Date of Patent: May 19, 2015

(54) TOOL PACKAGING

(71) Applicant: Robert Bosch GmbH, Stuttgart (DE)

(72) Inventors: Dirk Andrich, Crailsheim (DE); Ralf Schubert, Crailsheim (DE); Valentin Koehler, Crailsheim (DE); Ueli Diener, Balsthal (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/726,087

(22) Filed: Dec. 22, 2012

(65) Prior Publication Data

US 2013/0175191 A1 Jul. 11, 2013

(30) Foreign Application Priority Data

Dec. 29, 2011 (DE) ..... 10 2011 090 061

(51) Int. Cl.

| | |
|---|---|
| ***B65D 85/28*** | (2006.01) |
| ***B65D 75/14*** | (2006.01) |
| ***B31B 1/74*** | (2006.01) |
| ***B65D 25/54*** | (2006.01) |
| ***B65D 73/00*** | (2006.01) |

(52) U.S. Cl.
CPC . *B65D 75/14* (2013.01); *B31B 1/74* (2013.01); *B65D 25/54* (2013.01); *B65D 73/0078* (2013.01)

(58) Field of Classification Search
CPC ..... B31B 1/74; B65D 25/54; B65D 73/0078; B65D 75/14
USPC ..... 206/349, 372, 373, 377–379, 461–471, 206/525, 526, 806
See application file for complete search history.

(56) References Cited

U.S. PATENT DOCUMENTS

| | | | | |
|---|---|---|---|---|
| 2,343,715 | A * | 3/1944 | Taylor | 206/349 |
| 3,130,834 | A * | 4/1964 | Korzaan | 206/349 |
| 3,972,417 | A * | 8/1976 | Iten et al. | 206/461 |
| 4,239,104 | A * | 12/1980 | Roccaforte et al. | 206/526 |
| 4,619,364 | A * | 10/1986 | Czopor, Jr. | 206/379 |
| 4,653,637 | A * | 3/1987 | Wallace | 206/372 |
| 4,915,231 | A * | 4/1990 | Perbet et al. | 206/461 |
| 5,291,996 | A * | 3/1994 | Linden | 206/349 |
| 5,456,057 | A * | 10/1995 | Bannon et al. | 206/349 |
| 6,267,239 | B1 * | 7/2001 | Maki | 206/349 |
| 7,344,026 | B2 * | 3/2008 | Melgaard | 206/349 |
| 2001/0008215 | A1 * | 7/2001 | Colombo | 206/379 |
| 2011/0139645 | A1 * | 6/2011 | Ranieri et al. | 206/349 |

FOREIGN PATENT DOCUMENTS

| | | | |
|---|---|---|---|
| DE | 9102473 | U1 | 7/1991 |
| DE | 9107126 | U1 | 9/1991 |
| DE | 195 47 061 | A1 | 6/1997 |
| EP | 0 559 167 | A1 | 9/1993 |
| EP | 1 338 527 | A1 | 8/2003 |

* cited by examiner

*Primary Examiner* — Bryon Gehman
(74) *Attorney, Agent, or Firm* — Maginot, Moore & Beck LLP

(57) ABSTRACT

An insertion tool packaging, includes a main body that has at least one hanging region, at least one viewing region, and at least one receiving region, which is configured at least substantially to receive at least one insertion tool. The packaging further includes at least one protective element, which is configured to at least substantially protect a user against injury.

20 Claims, 3 Drawing Sheets

TOOL PACKAGING

This application claims priority under 35 U.S.C. §119 to patent application no. DE 10 2011 090 061.6 filed on Dec. 29, 2011 in Germany, the disclosure of which is incorporated herein by reference in its entirety.

BACKGROUND

The typical packaging is known to those of ordinary skill in the art.

SUMMARY

The disclosure relates to a packaging, in particular an insertion tool packaging, comprising a main body, which has at least one viewing region and at least one receiving region, which is provided at least substantially to receive at least one insertion tool, and comprising at least one protective element, which is provided at least substantially for protection, in particular against injury to a user.

It is proposed to form the protective element integrally with the main body, at least in part. "Provided" is to be understood to mean in particular specifically designed, formed and/or equipped. In this context, a "viewing region" is to be understood to mean in particular a region that is provided to allow an observer to see at least partially into the packaging and/or to see at least one product contained therein. In this context, a "receiving region" is to be understood to mean in particular a region that is provided to receive at least one product, preferably at least one insertion tool. In this context, "receive" is to be understood to mean to secure in at least one direction. The receiving region preferably contacts the at least one product directly. In this context, a "protective element" is to be understood to mean in particular an element that is provided to protect a user against injuries when handling the packaging, in particular against cuts, caused by the product contained in the packaging. In a particularly preferred exemplary embodiment, the protective element is provided to cover at least partially, but preferably at least substantially completely, a machining region in particular, preferably a cutting edge, of the insertion tool encased by the packaging according to the disclosure. In this context, "integrally" is to be understood to mean in particular formed in one piece, for example by production from a cast part and/or by production in conventional injection molding or sandwich molding and advantageously from a single blank. It is also conceivable, however, for the at least one protective element to be integrally bonded to the main body of the packaging, for example by a welding process, an adhesive bonding process, an injection process and/or another process that appears to be expedient to a person skilled in the art.

As a result of the embodiment according to the disclosure, a packaging that is of simple construction can be achieved, wherein an advantageously low level of complexity of the production process and therefore preferably low production costs are achieved. Furthermore, a preferably reliable and fault-free production process, in particular with just a single punching procedure, can be achieved. As a result of the embodiment of the protective element according to the disclosure, it is possible to dispense with a separate processing step to apply and erect the protective element. Fewer installation procedures can thus be achieved during the process of producing the packaging. Furthermore, an external appearance remains practically unchanged, in spite of the advantageous modification to the packaging compared to packagings that are already known, thus resulting in a preferably high level of market acceptance of the packaging according to the disclosure by a customer.

It is further proposed to form the main body out of cardboard, at least in part. In this context, a "cardboard" is to be understood to mean in particular a material that contains cellulose, at least in part, which can be obtained for example from used paper or wood pulp, and/or that contains fibrous material and/or that consists of at least two, preferably more, layers of a paper in particular. Low material costs, an advantageously cost-effective production of the packaging and a preferably simple production process can thus preferably be achieved. Furthermore, an advantageously high stability of the packaging can be achieved.

It is also conceivable for the main body to be formed from a plastics material, at least in part. A "plastics material" is to be understood to mean in particular a material that is formed by an organic polymer and that is formed at least in part from at least one monomeric, organic substance that has been produced synthetically in particular. An advantageously robust and water-resistant embodiment of the packaging can thus be achieved.

It is also proposed for the protective element to be formed from cardboard. In this context, a "cardboard" is to be understood to mean in particular a material that contains cellulose, at least in part, which can be obtained for example from used paper or wood pulp, and/or that contains fibrous material and/or that consists of at least two, preferably of more, layers of a paper in particular. Low material and production costs as well as a preferably simple production process can thus preferably be achieved. Furthermore, a preferably reliable and secure protective element can be provided.

It is also conceivable for the at least one protective element to be formed from a plastics material, at least in part. A "plastics material" is to be understood to mean in particular a material that is formed by an organic polymer and that is formed at least in part from at least one monomeric, organic substance that has been produced synthetically in particular. An advantageously robust and water-resistant embodiment of the at least one protective element can thus be achieved.

In addition, it is proposed for the protective element to have at least one curved edge. In this context, "curved" is to be understood to mean in particular that the edge at least substantially has the contour of a circular arc. A preferably high level of protection can thus be achieved by the protective element, wherein the production costs and the level of complexity of the production process can be kept low advantageously. Other forms of an edge of the at least one protective element that appear to be expedient to a person skilled in the art are also conceivable, for example a triangular, rectangular or undulating edge.

It is also proposed for the viewing region to comprise at least one recess. In this context, a "recess" is to be understood to mean in particular a material weakening that extends into the material, in particular perpendicular to a surface of the material. The recess preferably extends at least in part, but preferably completely, through a material thickness. Due to the at least one recess within the viewing region, it is possible to obtain an advantageously good view into the inside of the packaging and preferably of a product contained in the packaging.

In addition, it is proposed for the protective element to define the at least one recess in the viewing region, at least in part. An advantageously compact and at the same time preferably secure embodiment of the protective element can thus be achieved. Furthermore, a shape of the at least one recess in the at least one viewing region can be modified advantageously in a simple manner by the embodiment according to the disclosure and can be adapted in a versatile manner to a product that is to be encased by the packaging as well as to customer requirements.

It is further proposed for the packaging to have a hanging region, which has at least one recess, which is provided at least substantially to store the main body in at least one state. In this context, a "hanging region" is to be understood to mean in particular a region that is provided to store the packaging in at least one state, preferably in at least one folded state. The hanging region is preferably provided to store the packaging in particular in a hanging manner. However, it is also conceivable for the packaging to be provided to be stored in a stacked manner. In this context, a "recess" is to be understood to mean in particular a material weakening that extends into the material, in particular perpendicular to a surface of the material. The recess preferably extends at least in part, but preferably completely, through a material thickness. An advantageously cost-effective embodiment, which at the same time can be implemented in a simple and versatile manner, of the hanging region can thus be achieved.

BRIEF DESCRIPTION OF THE DRAWINGS

Further advantages will become clear from the following description of the drawing. Exemplary embodiments of the disclosure are illustrated in the drawing. The drawing, the description and the claims contain numerous features in combination. A person skilled in the art will also consider the features individually as appropriate and will combine them to form further expedient combinations.

In the drawings.

DETAILED DESCRIPTION

Figure 1:
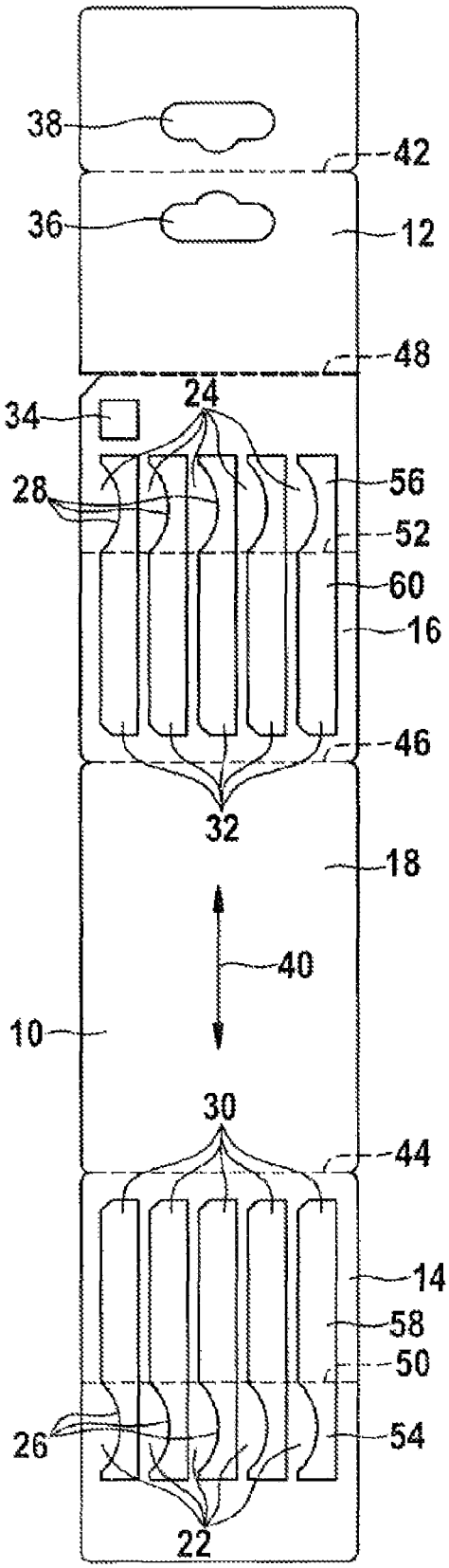
FIG. 1 shows a plan view of a packaging according to the disclosure in an unfolded state.

A blank of a packaging in an unfolded state is illustrated in FIG. 1. The packaging is formed by an insertion tool packaging. The packaging has a main body 10. The main body 10 is formed from cardboard. The main body 10 is punched out in a production process in a production step. It is also conceivable to cut out the main body 10 in a single production step or to separate it in another manner that appears to be expedient to a person skilled in the art.

The main body 10 has a hanging region 12. The hanging region 12 is arranged in a primary direction of extension 40 of the main body 10, as viewed at one end of the main body 10. The hanging region 12 has a recess 36, 38, which is provided for storage of the main body 10 in a folded state. The hanging region 12 has two recesses 36, 38. The recesses 36, 38 are formed as euro-holes, wherein the recesses 36, 38 each comprise a slot-shaped region and a semi-circular region adjoined centrally to the slot-shaped region. The recesses 36, 38 in the hanging region 12 are arranged in a mirror-inverted manner relative to one another. The hanging region 12 has a fold line 42. The fold line 42 is provided for folding of the main body 10 along the fold line 42. The fold line 42 corresponds to a mirror line between the recesses 36, 38. When the main body 10 is folded along the fold line 42, the recesses 36, 38 in the hanging region 12 overlap one another.

The main body 10 further has a receiving region 18. The receiving region 18 is provided to receive at least one insertion tool 20. The receiving region 18 is provided to receive a plurality of insertion tools 20. The receiving region 18 is provided to receive five insertion tools 20. It is also conceivable for the receiving region 18 to be provided to receive another number of insertion tools 20 that appears to be expedient to a person skilled in the art. The insertion tools 20 are formed by jigsaw blades. The insertion tools 20 are placed into the receiving region 18 parallel to one another and parallel to the primary direction of extension 40. The receiving region 18 is arranged in the primary direction of extension 40 of the main body 10 between the hanging region 12 and an end of the main body 10 opposite the hanging region 12. The receiving region 18 comprises an at least substantially rectangular area. The receiving region 18 is defined in the primary direction of extension 40 by a fold line 44, 46 in each case. The fold lines 44, 46 are provided to fold the main body 10 along the fold lines 44, 46. The fold lines 44, 46 extend perpendicular to the primary direction of extension 40 and parallel to one another.

The main body 10 has a viewing region 14, 16. The main body 10 has two viewing regions 14, 16. The viewing regions 14, 16 each adjoin the receiving region 18 in the primary direction of extension 40. The first viewing region 14 is arranged at an end of the main body 10 remote from the hanging region 12 and extends in the primary direction of extension 40 as far as the receiving region 18. The further viewing region 16 is arranged in the primary direction of extension 40 between the receiving region 18 and the hanging region 12. A tear-off line 48 is provided between the further viewing region 16 and the hanging region 12. The tear-off line 48 has a material weakness of the main body 10. The tear-off line 48 is provided for separation of the hanging region 12 from the packaging by a user.

The first viewing region 14 has a recess 30. The first viewing region 14 has a plurality of recesses 30. The first viewing region 14 has five recesses 30. The recesses 30 are formed as viewing windows. The recesses 30 each have an at least substantially rectangular contour. The recesses 30 extend parallel to one another. The recesses 30 extend parallel to the primary direction of extension 40 of the main body 10.

Figure 3:
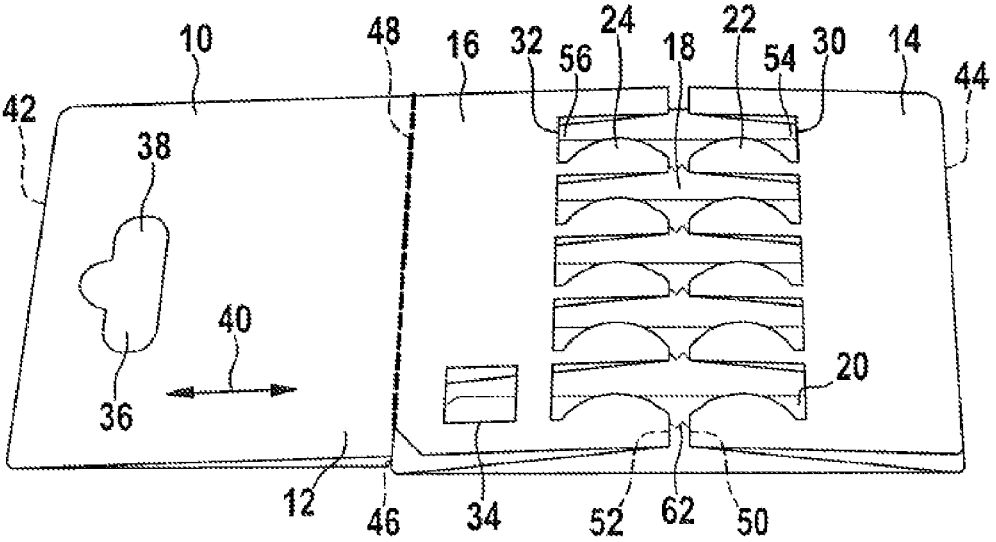
FIG. 3 shows the packaging according to the disclosure in a folded state.

The further viewing region 16 has a recess 32. The further viewing region 16 has a plurality of recesses 32. The further viewing region 16 has five recesses 32. The recesses 32 are formed as viewing windows. The recesses 32 each have an at least substantially rectangular contour. One corner of each of the recesses 32 is slanted. The recesses 32 extend parallel to one another. The recesses 32 extend parallel to the primary direction of extension 40 of the main body 10. The further viewing region 16 has a further recess 34. The further recess 34 is at least substantially square. The further recess 34 is provided to release part of an insertion tool 20 retained in the packaging when the packaging is in the folded state (FIG. 3). The further recess 34 overlaps a product name of the insertion tool 20. The product name is printed onto the insertion tool 20.

Figure 2:
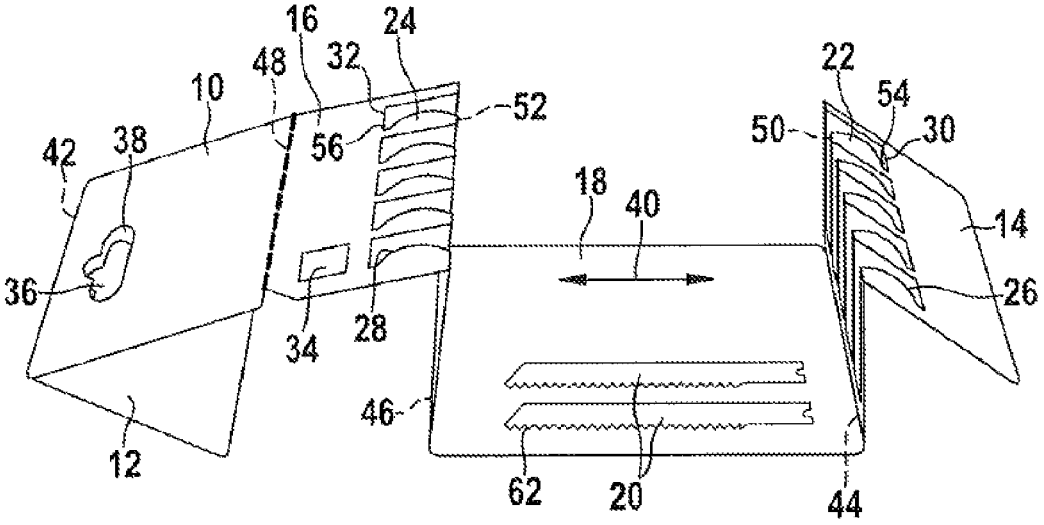
FIG. 2 shows a perspective illustration of the packaging according to the disclosure in a pre-folded state.

A fold line 50, 52 extends through the first viewing region 14 and through the further viewing region 16 in each case. The fold lines 50, 52 are arranged perpendicular to the primary direction of extension 40 of the main body 10. The fold lines 50, 52 divide the recesses 30 in the first viewing region 14 and the recesses 32 in the further viewing region 16 into a smaller sub-region 54, 56 and into a larger sub-region 58, 60 respectively. The fold line 50, 52 is provided to fold the main body 10 along the fold line 50, 52 (FIG. 2). When the main body 10 is folded, each of the smaller sub-regions 54, 56 of the recess 30, 32 overlaps the larger sub-region 58, 60 of the same recess 30, 32.

The packaging comprises a protective element 22, 24. The packaging has a plurality of protective elements 22, 24. The packaging has ten protective elements 22, 24. The protective elements 22, 24 are formed as finger protective elements. The protective elements 22, 24 are provided to protect a user against injury caused by the insertion tool 20 retained in the packaging. The protective elements 22, 24 are formed integrally with the main body 10. The protective elements 22, 24 are formed from cardboard. The protective elements 22, 24 are arranged in a region of the main body 10 that forms an outer layer facing away from the receiving region 18 when the packaging is in the folded state. The protective elements 22, 24 each have a curved edge 26, 28. Each protective element 22, 24 defines a respective one of the recesses 30, 32 in the viewing region 14, 16. Each curved edge 26, 28 of the protective element 22, 24 protrudes into a respective one of the recesses 30, 32 in the first and further viewing region 14, 16 and defines the recess 30, 32. The protective element 22, 24 protrudes into the respective smaller sub-region 54, 56 of the recess 30, 32 in the viewing region 14, 16.

When the packaging is folded, five insertion tools 20 formed by jigsaw blades lie in the receiving region 18 of the main body 10. Each one of the insertion tools 20 is overlapped by one of the recesses 30 in the first viewing region 14 and by one of the recesses 32 in the further viewing region 16 in each case. Merely the smaller sub-region 54, 56 of the recess 30, 32 is arranged so as to be visible to an observer in the folded state. The protective element 22, 24, which projects into the recess 30, 32 in the smaller sub-region 54, 56, overlaps a machining region 62 of the insertion tool 20 in the folded state. The machining region 62 of the insertion tool 20 has sawteeth. The further recess 34 in the further viewing region 16 overlaps a product name printed onto the insertion tools 20, and therefore this product name can be read by an observer when the packaging is folded.

Figure 4:
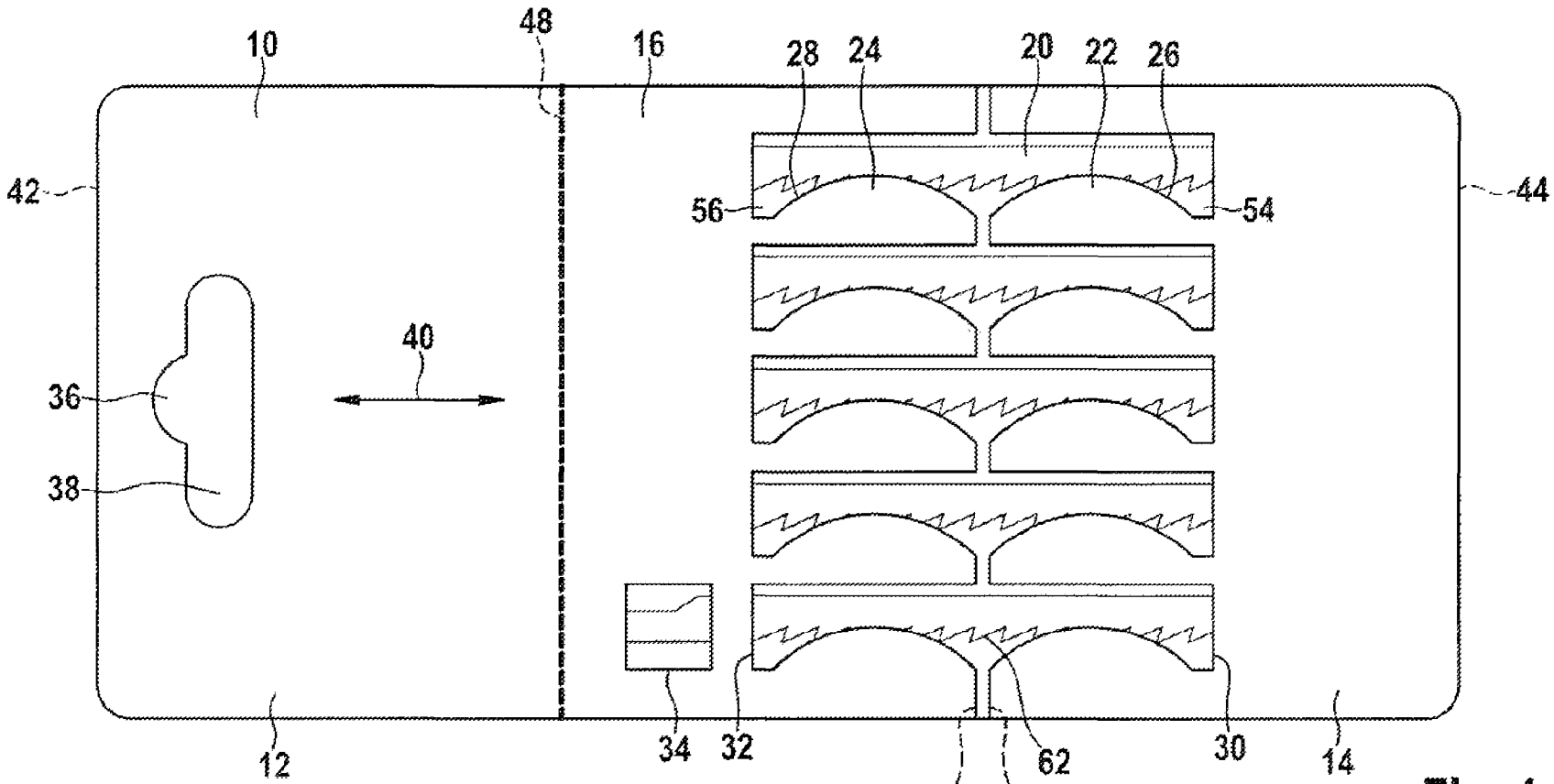
FIG. 4 shows a top plan view of the packaging according to the disclosure in the folded state.

To ensure that the packaging is held together, the regions of the main body 10 arranged between the fold lines 42, 44, 46, 50, 52 are glued together, at least in part, in the folded state (FIG. 4). For example, it is also conceivable to bond the packaging in the folded state by means of a film. Other methods that appear to be expedient to a person skilled in the art are also conceivable.

What is claimed is:

1. An insertion tool packaging, comprising:

a main body including:

at least one receiving region configured, at least substantially, to receive at least one insertion tool; and at least one viewing region having at least one recess configured to enable viewing of the at least one insertion tool, the at least one viewing region joined to the at least one receiving region at a first fold line, the at least one viewing region having a second fold line dividing the at least one recess into a first subregion and a second subregion; and at least one protective element configured, at least substantially, to protect against injury to a user by the at least one insertion tool, wherein the at least one protective element is formed integrally with the main body, at least in part, wherein the first subregion substantially covers the second subregion when the at least one viewing region is folded over the at least one receiving region at the first fold line and the at least one viewing region is folded at the second fold line, and wherein at least one edge of the first subregion forms at least part of the at least one protective element and substantially covers the second subregion.

2. The packaging according to claim 1, wherein the main body is formed from cardboard, at least in part.

3. The packaging according to claim 1, wherein the at least one protective element is formed from cardboard.

4. The packaging according to claim 1, wherein the at least one protective element includes at least one curved edge.

5. The packaging according to claim 1, wherein the at least one protective element protrudes into the first subregion.

6. The packaging according to claim 1, further comprising:

a hanging region including at least one recess, wherein the hanging region is configured, at least substantially, to store the main body in at least one state.

7. The packaging according to claim 6, wherein the hanging region includes a fold line.

8. The packaging according to claim 1, wherein the at least one receiving region is defined on each of two ends in a primary direction of extension by a corresponding fold line.

9. The packaging according to claim 1, wherein:

the at least one viewing region includes two viewing regions, and each of the viewing regions adjoins the at least one receiving region in a primary direction of extension.

10. The packaging according to claim 6, wherein a tear-off line is provided between at least one of the at least one viewing regions and the hanging region.

11. The packaging according to claim 9, wherein a corresponding fold line is configured to extend through each of the two viewing regions.

12. An insertion tool packaging, comprising:

a main body including:

at least one receiving region configured, at least substantially, to receive at least one insertion tool; and at least one viewing region having at least one recess configured to enable viewing of the at least one insertion tool, the at least one receiving region joined to the at least one viewing region at a first fold line, the at least one viewing region having a second fold line dividing the at least one recess into a first subregion and a second subregion; and at least one protective element configured, at least substantially, to protect against injury to a user by the at least one insertion tool, wherein the at least one protective element is formed integrally with the main body, at least in part, wherein the first subregion substantially covers the second subregion in a folded state of the packaging, and wherein an edge of the first subregion of the at least one recess forms at least part of the at least one protective element, substantially protrudes into the at least one recess, and substantially covers the second subregion.

13. The packaging as recited in claim 12, wherein the at least one protective element includes at least one curved edge.

14. The packaging as recited in claim 12, wherein the at least one protective element protrudes into the first subregion.

15. The packaging as recited in claim 12, further comprising a hanging region including at least one recess, the hanging region configured, at least substantially, to store the main body in at least one state.

16. The packaging as recited in claim 15, wherein the at least one viewing region includes two viewing regions, each viewing region adjoining the at least one receiving region in a primary direction of extension.

17. The packaging as recited in claim 15, further comprising a tear-off line provided between at least one of the two viewing regions and the hanging region.

18. The packaging as recited in claim 16, wherein a corresponding fold line is configured to extend through each of the two viewing regions.

19. The packaging as recited in claim 12, wherein the at least one receiving region is defined on each of two ends in a primary direction of extension by a corresponding fold line.

20. A method for producing a packaging including a main body and at least one protective element, comprising:

forming the at least one protective element integrally with the main body, at least in part, wherein the main body includes at least one viewing region and at least one receiving region, wherein the at least one receiving region is configured, at least substantially, to receive at least one insertion tool, wherein the at least one viewing region has at least one recess configured to enable viewing of the at least one insertion tool, the at least one viewing region joined to the at least one receiving region at a first fold line, the at least one viewing region having a second fold line dividing the at least one recess into a first subregion and a second subregion, wherein the at least one protective element is configured, at least substantially, to protect against injury to a user, and wherein the first subregion substantially covers the second subregion when the at least one viewing region is folded over the at least one receiving region at the first fold line and the at least one viewing region is folded at the second fold line, and wherein an edge of the first subregion forms at least part of the at least one protective element and substantially covers the second subregion.

* * * * *